United States Patent [19]

Sun

[11] Patent Number: 4,682,974

[45] Date of Patent: Jul. 28, 1987

[54] SLIP CASE PACKAGE

[76] Inventor: Robert J. Sun, 1409 Ferry St., Easton, Pa. 18042

[21] Appl. No.: 735,834

[22] Filed: May 20, 1985

[51] Int. Cl.[4] ..... B31B 1/88

[52] U.S. Cl. ..... 493/55; 493/89; 493/100; 493/140; 493/183; 493/915

[58] Field of Search ..... 493/89, 95, 100, 111, 493/140, 383, 386, 390, 915, 53, 55, 183, 906, 907; 53/169; 229/87 R, 9

[56] References Cited

U.S. PATENT DOCUMENTS

| | | | |
|---|---|---|---|
| 1,302,236 | 4/1919 | Smith | 229/40 |
| 1,826,264 | 10/1931 | Stokes | 493/111 |
| 1,907,519 | 5/1933 | Dietmann | 493/415 |
| 2,214,380 | 10/1940 | Nisbet | 312/330 R |
| 3,005,546 | 10/1961 | Sanford | 206/434 |
| 3,523,635 | 8/1970 | Croley et al. | 229/184 |
| 4,056,913 | 11/1977 | Bamburg et al. | 53/449 |
| 4,453,631 | 6/1984 | Mark | 206/313 |
| 4,497,401 | 2/1985 | Ackerman | 229/9 |

*Primary Examiner*—Frederick R. Schmidt
*Assistant Examiner*—Robert Showalter
*Attorney, Agent, or Firm*—Woodcock Washburn Kurtz Mackiewicz & Norris

[57] ABSTRACT

A slip case package for small articles includes a sleeve member and a drawer being slideably mounted therein. The sleeve member is formed by first providing a blank of relatively lightweight cardboard with graphic designs formed thereon. The blank is formed into a partially assembled sleeve portion and reinforcing member is inserted therein. The reinforced sleeve member has sufficient rigidity to act as a slip case package sleeve, but the graphics may be provided thereon with machine operations and with perfect alignment.

4 Claims, 7 Drawing Figures

SLIP CASE PACKAGE

FIELD OF THE INVENTION

The present invention relates, in general, to an improved container or carton for small articles and a method of making the same, and, in particular, it relates to an improved slip case package.

BACKGROUND OF THE INVENTION

Cardboard containers for small articles are well known. One type of such container is referred to as a slip case type package. With a slip case type package, a portion which might be referred to as a drawer or tray receives the articles which are to be contained. This drawer or tray is slideably received within a surrounding case or sleeve which provides an enclosure for the otherwise open top of the drawer or tray. Since the drawer or tray is slideably received within the sleeve, the package receives its name of slip case.

The existing method of making the sleeve of a slip case package starts with the formation of a stiff cardboard blank which is formed into a sleeve member and which is typically glued to retain its shape. Since slip case packages are utilized for the marketing of many products, printed graphics are thereafter affixed to the formed sleeve member, which identify the products contaided therein. To accomplish the affixation of the graphics, the graphics are first printed upon a wrapping material. The wrapping material is typically formed in two pieces, a top piece which covers the top and sides of the sleeve member of the slip case package and a separate bottom piece which is used to cover the bottom of the sleeve. The wrapping material is usually made of a thin, lightweight paper which is adhesively bonded to the sleeve. This method of construction presents certain limitations.

First, the wrapping material containing the printed graphics to be affixed to the sleeve of the slip case package is usually aligned by hand with respect to the sleeve and, as a result, tight borders on the graphics printed upon the wrap are a problem because of tolerances in alignment by hand. Also, because the wraps are made in two separate pieces, it is difficult to have graphic designs which have continuous borders. Thus, because of this alignment problem, the type of graphics which may be used is limited. In addition, the thin paper wraps containing the graphics require hand operations that are difficult to mechanize, thus making the slip case package expensive to produce.

While it would be desirable to print the required graphics directly on the surface of the stiff cardboard material used to form the sleeve member itself, the cardboard does not lend itself to traditional high quality printing techniques.

It would be desirable to provide an improved slip case package and method of making the same which did not suffer from the aforementioned disadvantages.

Specifically, it would be desirable to provide an improved slip case package and method of making the same which eliminate the necessity of employing two piece paper wraps having graphics thereon for applying trade information to the package.

It would be further desirable to provide an improved slip case package and method of making the same which did not suffer from the graphic alignment problems typical of prior art slip case packages.

Still further, it would be desirable to provide an improved slip case package and method of making the same in which graphics could be affixed thereto in highly efficient machine handling operations.

SUMMARY OF THE INVENTION

The foregoing objectives are achieved by the method of making a slip case package in accordance with the present invention. This method comprises the provision of a blank of relatively lightweight cardboard having a body portion with a plurality of end flaps projecting therefrom, the blank having graphic designs formed thereon. In accordance with the present invention, the blank is formed into a partially assembled sleeve member, the body portion of the blank defining a central cavity of the partially assembled sleeve member, the partially assembled sleeve member having at least one open end. Next, in accordance with the present method, a reinforcing member having the same shape as the central cavity and sized to fit within it is inserted through that open end. After the reinforcing member has been inserted within the sleeve member, the end flaps at the aforementioned end are turned inwardly into the central cavity thus securing the reinforcing member therein. Thereafter, a drawer dimensioned to fit within the central cavity is provided which slideably engages with the sleeve member.

The provision of the aforementioned reinforcing member provides rigidity to the sleeve despite the fact that the sleeve is formed from a blank of relatively lightweight material. The blank from which the sleeve is made is sufficiently thin and lightweight such as to be amenable to the mechanized affixation of high quality graphics thereon.

BRIEF DESCRIPTION OF THE DRAWING

The present invention will be more fully understood by reference to the drawings in which.

DETAILED DESCRIPTION OF THE PREFERRED EMBODIMENT

Figure 1:
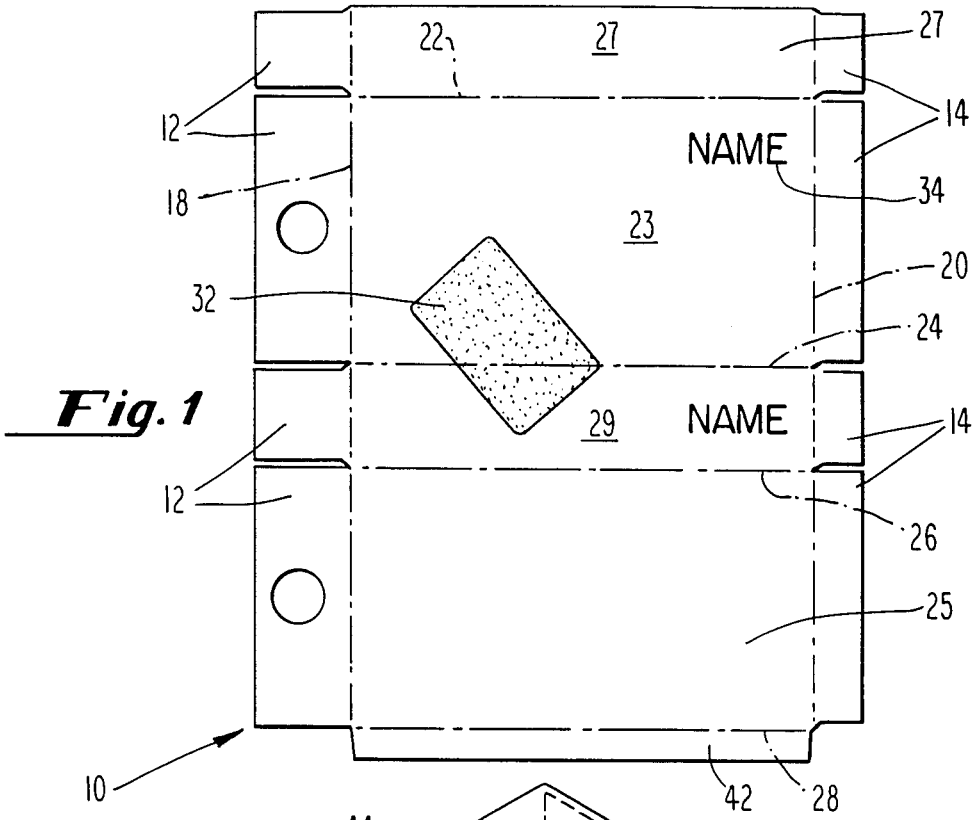
FIG. 1 is a plan view of a lightweight cardboard blank utilized to form the sleeve of the slip case package of the present invention.

Referring now to the drawings, the improved slip case package of the present invention as well as the method of making the same will be described in detail.

Referring first to FIG. 1, a lightweight cardboard blank approximately 0.020 inches thick is shown generally at 10. The cardboard blank 10 includes integral side wings or flaps 12 and 14 abutting the main body portion of the blank at fold lines 18 and 20 respectively. The main body of the blank 10 includes fold lines 22, 24, 26, and 28 which are orthogonal to the fold lines 18 and 20 and which define the ultimate top 23, bottom 25, and side portions 27 and 29 of the slip case package sleeve.

In accordance with an important aspect of the present invention, because the slip case package sleeve blank 10 is formed of lightweight cardboard material, it may be imprinted directly with high quality graphic designs such as, for example, the pattern shown at 32 and the alpha-numeric characters shown at 34. These graphic designs may be imprinted upon the blank 10 using mechanized procedures. Moreover, because they are printed in the flat, the graphic designs such as, for example, the design 32 may be formed in locations which span the various fold lines 22, 24, or 26 such that continuous designs such as 32 may reside on both the top 23 and the sides 27 or 29 of the completed slip case package without any problems of alignment.

Figure 2:
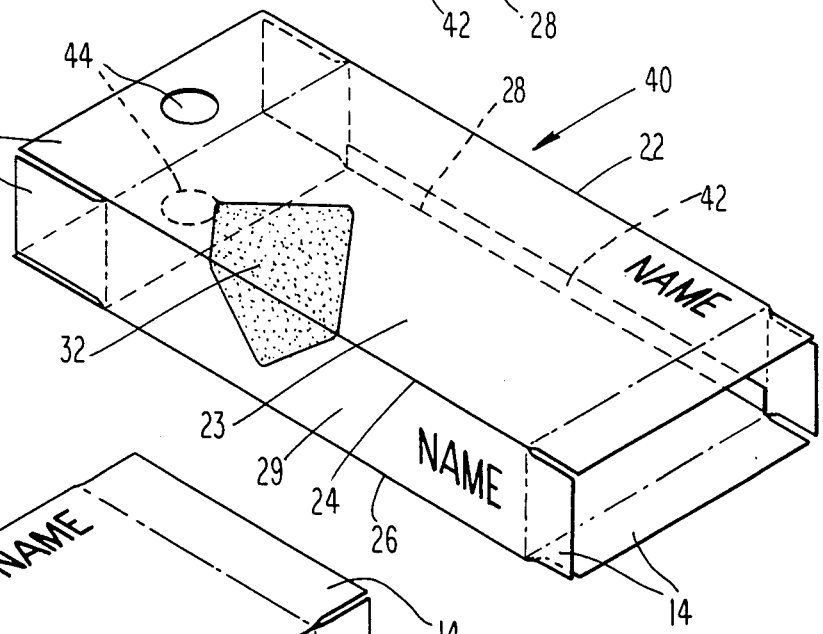
FIG. 2 is a perspective view of a partially assembled slip case sleeve made from the cardboard blank of FIG. 1 as it exists after a first operation.

Referring now to FIG. 2, the first step in the transformation of the blank 10, having graphics already imprinted thereon, into a slip case sleeve 40 will be seen. As shown in FIG. 2, the blank 10 is folded along fold lines 22, 24, 26, and 28 and is glued at flap 42 to yield a partially assembled slip case sleeve member having a central cavity therin. Also, as shown in FIG. 2, the graphic design 32, which spans the fold line 24, is present on both the top 23 and one side surface 29 of the sleeve 40.

Figure 3:
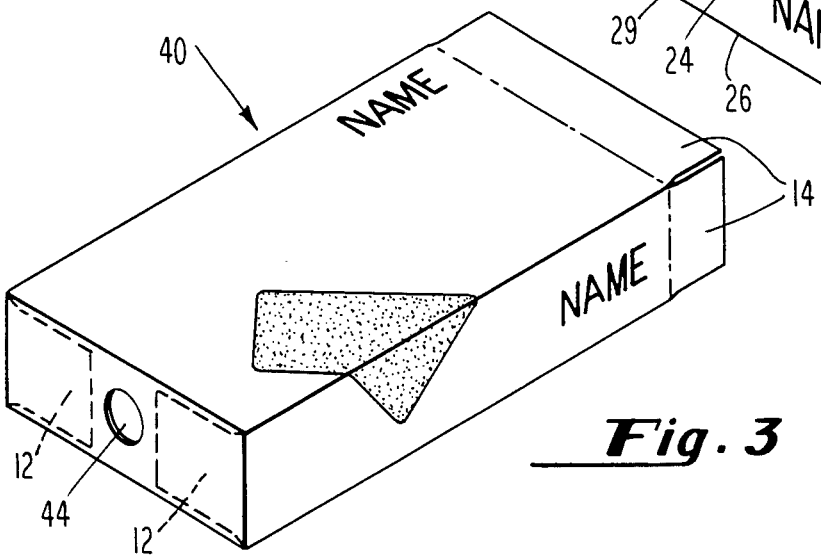
FIG. 3 is a perspective view of a partially assembled slip case sleeve at the conclusion of a second operation.

Referring now to FIG. 3, the second step in the transformation of the blank 10 to the sleeve 40 will be seen. As shown in FIG. 3, the end flaps 12 are folded inwardly to fully close one end of the sleeve 40. In accordance with the preferred embodiment of the present invention, two of the end flaps 12 include a finger aperture 44, the purpose of which will become apparent below. As shown in FIG. 3, the end flaps 14 are not immediately folded inwardly.

Figure 4:
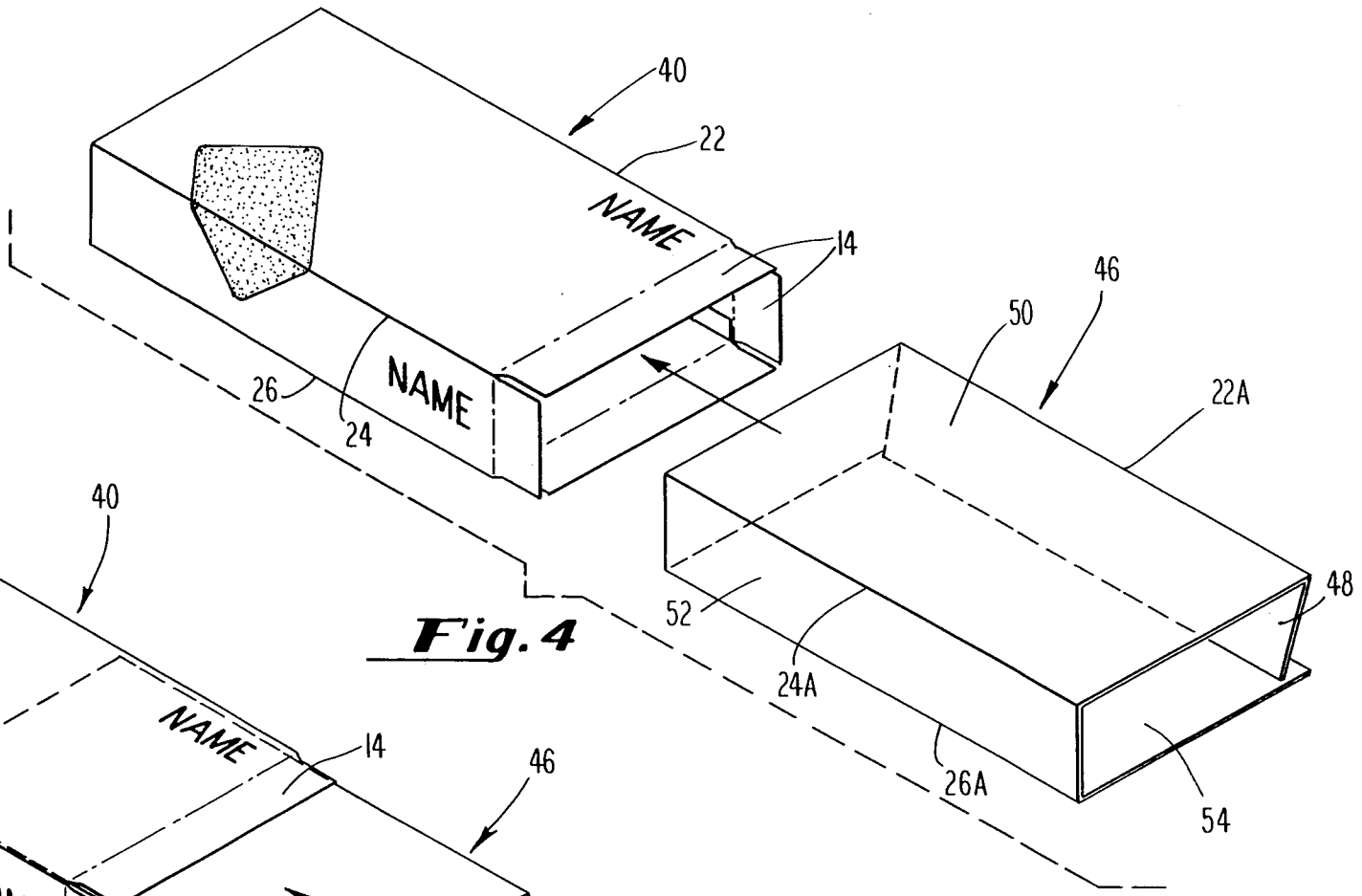
FIG. 4 is a perspective view of the partially assembled slip case sleeve of FIG. 3 and of a reinforcing member prior to insertion within that partially assembled slip case sleeve.

Referring now to FIG. 4, the next step in the transformation of the blank 10 to the slip case package sleeve 40 will be seen. As shown in FIG. 4, and in accordance with an important aspect of the present invention, a reinforcing member 46 is provided. The reinforcing member 46 includes a single piece of relatively stiff, heavyduty cardboard as compared to the blank 10. The reinforcing member 46 includes fold lines 22A, 24A, and 26A which define a plurality of panels 48, 50, 52, and 54. The panel 48 is not affixed to the panel 54, whereas the other panels are joined to adjacent panels at the fold lines 22A, 24A, and 26A. In accordance with an important aspect of the present invention, the reinforcing member is sized to fit within the central cavity of the partially assembled sleeve 40 and has dimensions slightly smaller than the sleeve.

Figure 5:
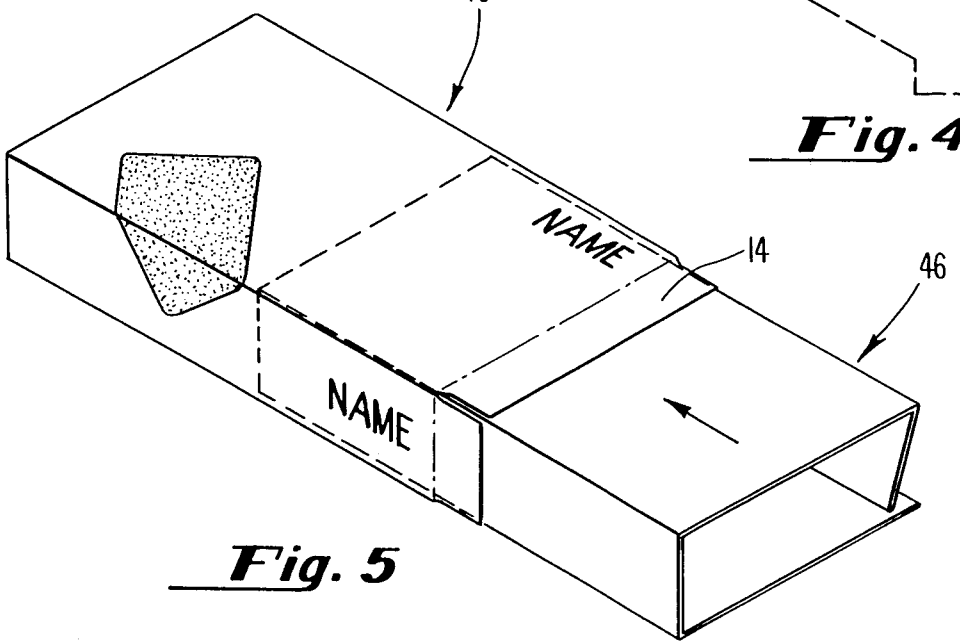
FIG. 5 is a perspective view of the partially assembled slip case sleeve of FIG. 3 showing the reinforcing member of FIG. 2 in the process of being inserted therein.
Figure 6:
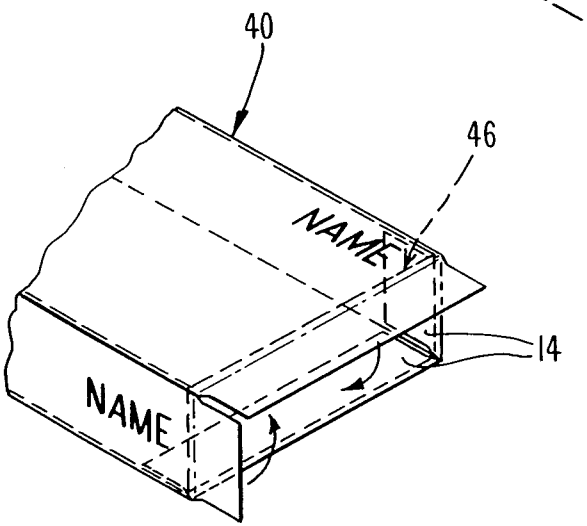
FIG. 6 is a perspective view of the partially assembled slip case sleeve, having the reinforcing member of FIG. 4 fully inserted therein.

Referring now to FIG. 5, in the next step of the present methods the reinforcing member 46 is inserted within the partially assembled sleeve 40 to provide rigidity to the sleeve. As shown in FIG. 6, once the reinforcing member 46 is fully inserted within the partially completed sleeve 40, the end flaps 14 are folded inwardly and glued in place, thus retaining the reinforcing member 46 in the inserted position. The insertion of the reinforcing member 46 provides rigidity to the relatively thin, lightweight sleeve member 40.

Figure 7:
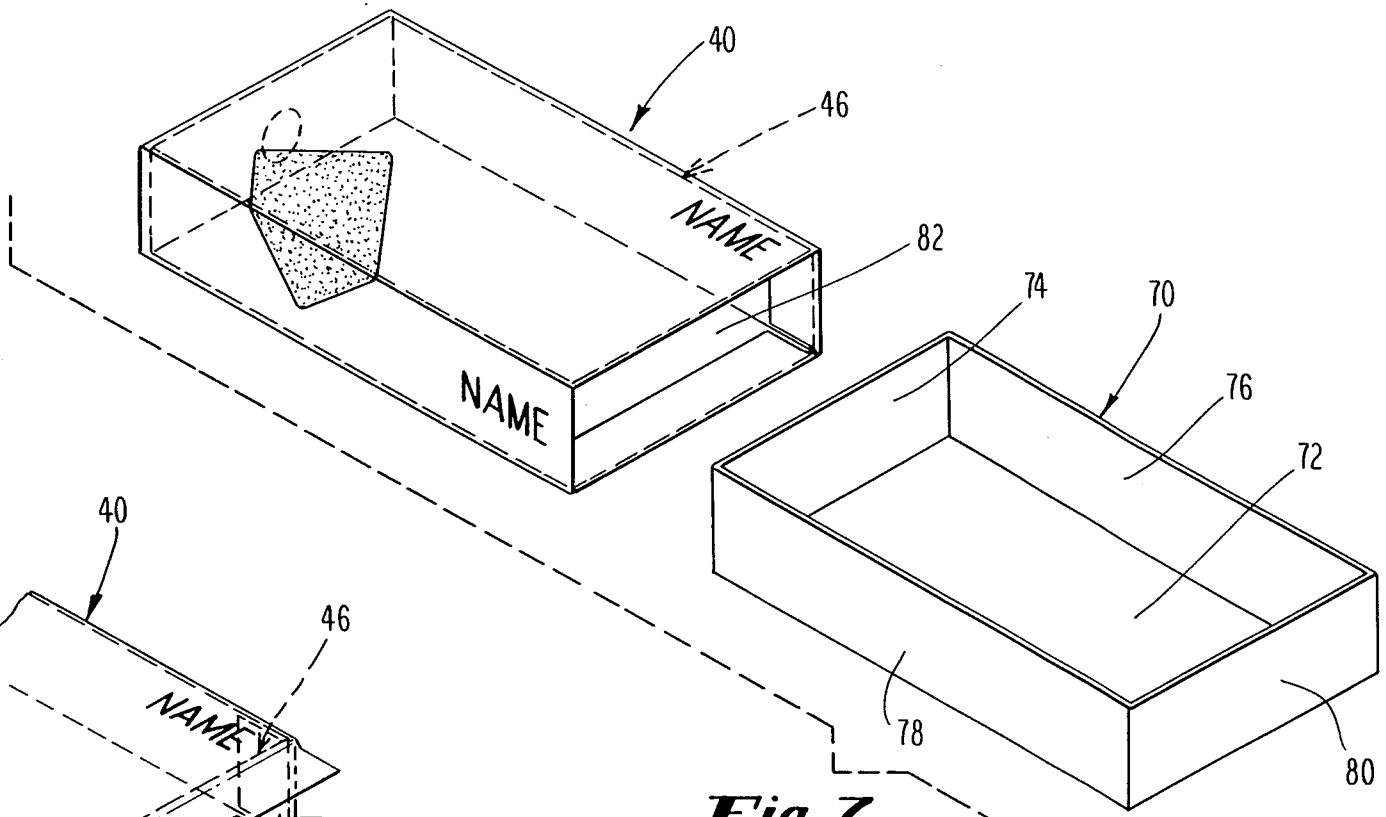
FIG. 7 is a perspective view of the completed slip case sleeve and slip case drawer shown in relation thereto.

Referring now to FIG. 7, the assembly of the completed slip case package will be described. As shown in FIG. 7, the slip case sleeve 40 having the reinforcing member 46 inserted therein is aligned with a slip case drawer or tray shown generally at 70. The slip case drawer or tray 70 includes a bottom portion 72 and sidewalls 74, 76, 78, and 80 which are all slideably received within an open end 82 of the completed slip case sleeve 40. Once the slip case drawer or tray 70 is inserted within the completed slip case sleeve 40, it may be extracted therefrom by force exerted through the finger aperture 44 bearing against the sidewall surface 74 of the drawer 80.

While one embodiment of the slip case package of the present invention is illustrative, the present invention should be accorded a scope sufficient to cover equivalent constructions within the purview of the appended claims.

What is claimed is:

1. A method of making a slip case package for containing small articles, said package including a sleeve member and a drawer being slideably received therein, said method comprising:

providing a blank of relatively lightweight cardboard having a body portion with a plurality of end flaps projecting therefrom, said blank having graphic designs formed thereon;

forming said blank into a partially assembled sleeve member, said body portion of said blank defining a central cavity in said partially assembled sleeve member, said partially assembled sleeve member having at least one open end with said plurality of end flaps associated with said at least one open end projecting from said open end providing a reinforcing member having the shape of said central cavity and sized to fit within said central cavity;

inserting said reinforcing member within said central cavity through said at least one open end;

securing said reinforcing member within said central cavity by folding said end flaps into said cavity at said open end over an end of said reinforcing member in order to complete the assembly of said sleeve member;

providing a drawer dimensioned to fit within said cavity; and slideably engaging said drawer within said sleeve member.

2. The method of claim 1 wherein said securing step further comprises:

adhesively bonding said end flaps to secure said reinforcing member.

3. The method of claim 1 wherein said blank includes a plurality of fold lines and wherein said forming further comprises:

folding said blank along said fold lines to define said central cavity.

4. A method of making a slip case package for containing small articles, said package including a sleeve member and a drawer being slideably received therein, said method comprising:

providing a blank of relatively lightweight cardboard having a body body portion with a plurality of end flaps projecting therefrom, said blank having graphic designs formed thereon;

folding said blank to form a partially assembled sleeve member, the body portion of said folded blank defining a central cavity having a first and a second open end, said end flaps being situated adjacent to and projecting from said first and said second open ends of said cavity;

providing a reinforcing member having the shape of said central cavity, said reinforcing member being sized to fit within central cavity;

inserting said reinforcing member within said central cavity through said first end;

folding end flaps adjacent to said one end into said central cavity;

adhesively bonding said folded end flaps to said reinforcing member;

providing a drawer dimensioned to fit within said cavity; and slideably engaging said drawer within said sleeve member.

* * * * *